United States Patent [19]

Bania et al.

[11] Patent Number: 4,943,412

[45] Date of Patent: Jul. 24, 1990

[54] HIGH STRENGTH ALPHA-BETA TITANIUM-BASE ALLOY

[75] Inventors: Paul J. Bania, Boulder City; Warren M. Parris, Las Vegas, both of Nev.

[73] Assignee: Timet, Pittsburgh, Pa.

[21] Appl. No.: 345,561

[22] Filed: May 1, 1989

[51] Int. Cl.[5] ..... C22C 14/00

[52] U.S. Cl. ..... 420/420; 148/421

[58] Field of Search ..... 420/417, 418, 419, 420, 420/421; 148/421

[56] References Cited

U.S. PATENT DOCUMENTS 2,893,864 7/1959 Harris et al. ..... 420/419

FOREIGN PATENT DOCUMENTS 781535 8/1957 United Kingdom ..... 420/420

*Primary Examiner*—Theodore Morris
*Assistant Examiner*—Margery S. Phipps
*Attorney, Agent, or Firm*—Finnegan, Henderson, Farabow, Garrett & Dunner

[57] ABSTRACT

An alpha-beta titanium base alloy comprising, in weight percent, 0.04 to 0.10 silicon and 0.03 to 0.08 carbon, characterized by an increase in strength over that of the alloy lacking the silicon and carbon additions. The alloy may additionally comprise 6 aluminum, 4 vanadium, up to 0.3 iron and up to 0.25 oxygen.

2 Claims, No Drawings

HIGH STRENGTH ALPHA-BETA TITANIUM-BASE ALLOY

BACKGROUND OF THE INVENTION

1. Field of the Invention

This invention relates to an alpha-beta titanium-base alloy having improved strength to facilitate the use of the alloy in the form of castings.

2. Description of the Prior Art

The most widely used titanium-base alloy is Ti-6Al-4V, which is particularly adapted for use in producing castings.

It is advantageous with respect to this alloy to increase the strength thereof without significantly adversely affecting the ductility and toughness. This would contribute to the overall utility of the alloy, particularly in the form of castings.

SUMMARY OF THE INVENTION

It is accordingly a primary object of the present invention to provide an alpha-beta titanium-base alloy characterized by improved strength.

A more specific object of the invention is to provide the alpha-beta, titanium-base alloy comprising 6% aluminum and 4% vanadium, with additional elements for improving the strength thereof.

In accordance with the invention, an alpha-beta, titanium-base alloy has as alloying additions 0.04 to 0.10% silicon and 0.03 to 0.08% carbon, which additions increase the strength of the alloy over that absent these additions.

Preferably, the alloy may comprise these alloying additions with 6% aluminum and 4% vanadium, with up to 0.3% iron and up to 0.25% oxygen.

In the examples and throughout the specification and claims, all parts and percentages are by weight percent unless otherwise specified.

DETAILED DESCRIPTION OF THE PREFERRED EMBODIMENTS

In the evaluations leading to and demonstrating the invention, silicon and carbon additions, either singly or in combination, were added to a designated base composition and compared to nitrogen additions made to the same base composition from the standpoint of achieving increased strength. The results of this evaluation with respect to as-cast 100-gm button ingots are presented in Table I.

TABLE I

Ti—6 Al—4 V MINOR CHEMISTRY STUDY

Condition: As-cast 100 gm button; beta annealed + 1100° F./8 hr age

| Chemistry* | R.T. Tensile Properties** YS (ksi) | UTS (ksi) | % El | % RA |
|---|---|---|---|---|
| Base | 124.7 | 139.5 | 4.5 | 7.3 |
| | Change in R.T. Tensile Properties | | | |
| | Δ YS | Δ UTS | Δ % El | Δ % RA |
| Base + 016 N | 1.9 | 4.3 | −1.0 | .6 |
| Base + .020 N | 2.8 | 3.1 | −.5 | 3.6 |
| Base + .015 Si | 1.3 | 1.4 | 1.5 | 4.9 |
| Base + .020 Si | −.3 | .6 | 2.0 | 2.1 |
| Basa + .023 C | −.5 | −4.5 | 1.0 | 7.4 |
| Base + .032 C | 5.5 | 3.7 | 2.5 | 4.6 |
| Base + .023 C + .019 Si | 7.1 | 5.0 | .5 | 2.4 |

*Base chemistry is Ti—6.2 Al—4.1 V—.16 Fe—.19 $O_2$—.013 C—.025 Si—.002 N. All chemistries are avarage analyses of duplicate buttons.
**Tensile properties are averages of duplicates.

As may be seen from the data presented in Table I, the additions of carbon and silicon, in combination, resulted in a drastic improvement with respect to increased strength far exceeding that of nitrogen, silicon, and carbon alone.

Also evaluated were 250-gm buttons that were rolled to 0.5 inch diameter rod and then beta annealed to simulate an as-cast microstructure. The test results are presented in Table II.

TABLE II

Ti—6 Al—4 V MINOR CHEMISTRY STUDY

Condition: Rolled 250 gm buttons (½" dia round); beta annealed + 1100° F./8 hr age

| Chemistry* | R.T. Tensile Properties** YS (ksi) | UTS (ksi) | % El | % RA |
|---|---|---|---|---|
| Base | 131 | 148.9 | 9 | 12.3 |
| | Change in R.T. Tensile Properties | | | |
| | Δ YS | Δ UTS | Δ % El | Δ % RA |
| Base + .006 N | 3.7 | 1.8 | 0 | .4 |
| Base + .01 N | 2.7 | 1.9 | 0 | 1.4 |
| Base + .025 Si | 2.2 | 1.3 | 2.0 | .9 |
| Base + .028 Si | 2.4 | 2.0 | −.5 | 2.4 |
| Base + .008 C | 5.1 | 2.6 | −1.0 | −1.7 |
| Bass + .017 C | 6.4 | 2.5 | 0 | 2.3 |
| Base + .015 Si + .008 C | 3.5 | 3.4 | .5 | 1.2 |

*Base chemistry is Ti—6.4 Al—4.2 V—.12 Fe—.21 $O_2$—.016 C—.024 Si—.003 N. All chemistries are single analyses frm each button.
**Tensile properties are average of duplicate tests.

Again, strength was significantly improved by additions of carbon and silicon in accordance with the invention, without a significant deleterious effect on ductility. A series of 50 pound heats were produced and tested, and the results are presented in Table III.

TABLE III

Ti—6 A1—4 V MINOR CHEMISTRY STUDY

Condition: Forged + rolled 50 lb. heats (1" plate); beta annealed + 1100° F./8 hr age

| Chemistry* | R.T. Tensile Properties** YS (ksi) | UTS (ksi) | % El | 5 RA | RT Toughness*** $K_Q$ (ksi-in ½) |
|---|---|---|---|---|---|
| Base | 126.0 | 136.9 | 12.1 | 18.9 | 62.4 |
| | Change in R.T. Properties | | | | |
| | Δ YS | Δ UTS | Δ % El | Δ % RA | Δ $K_Q$ |
| Base + .014 N | −.8 | 1.0 | −2.2 | −2.5 | 1.0 |
| Base + .021 N | 6.5 | 5.3 | −1.6 | −2.5 | 1.7 |
| Base + .017 Si | −.3 | −.9 | −.1 | .5 | 1.1 |
| Base + .031 Si | −.5 | −1.7 | −2.6 | −.9 | −1.1 |
| Base + .013 C | −3.5 | −3.5 | 1.2 | 1.7 | 1.8 |
| Base + .04 C | 1.8 | .1 | −4.0 | −6.5 | 3.0 |

TABLE III-continued

| Ti—6 Al—4 V MINOR CHEMISTRY STUDY | | | | | |
|---|---|---|---|---|---|
| Condition: Forged + rolled 50 lb. heats (1" plate); beta annealed + 1100° F./8 hr age | | | | | |
| Base + .012 C + .016 Si | 7.6 | 6.3 | −2.4 | −3.9 | 0.4 |

*Base chemistry is Ti—6.3 Al—4.2 V—.21 Fe—.15 $O_2$—.007 N—.024C—.028 Si. Chemistries are average of ingot T & B analyses.
**Average of four tests (2L and 2T)
***Average of four tests with pre-cracked Charpy specimens (2L-T and 2T-1.)

Again, a beta anneal was used to simulate the as-cast structure. The test results show a strength increase of 6–7 ksi with about a 2–4% loss in ductility for an alloy having carbon and silicon additions. The toughness was unchanged.

The alloy was then examined after a simulated recrystallization anneal thermal cycle, and the results are set forth in Table IV.

TABLE IV

| Ti—6 Al—4 V MINOR CHEMISTRY STUDY | | | | | | |
|---|---|---|---|---|---|---|
| Condition: Forged + Rolled 50 lb heats (1 in plate): Beta annealed plus recrystallized annealed | | | | | | |
| | R.T. Tensile Properties* | | | | R.T. Toughness* | |
| Chemistry | YS (ksi) | UTS (ksi) | % El (%) | % RA (%) | $K_Q$ (ksi-in½) | $J_m$ (in-lb/in²) |
| Base** | 113.5 | 126.7 | 11 | 23 | 63.6 | 1077 |
| | Change in Properties Compared to Base | | | | | |
| | Δ YS | Δ UTS | Δ % El | Δ % RA | Δ $K_Q$ | Δ $J_m$ |
| Base + .014 N | 3.3 | 3.3 | 0.8 | −1.1 | −1.2 | 64 |
| Base + .021 N | 4.7 | 4.1 | 0.1 | −3.8 | −.3 | −138 |
| Base + .017 Si | 2.3 | 0.3 | 1.0 | −1.3 | −0.9 | 122 |
| Base + .031 Si | 0.7 | 0.8 | 0.8 | −.6 | −.6 | 185 |
| Base + .013 C | 0.8 | 0.8 | 0 | 0.5 | 0 | −108 |
| Base + .04 C | 3.0 | 2.1 | −0.5 | −4.2 | 0.1 | −80 |
| Base + .012 C + .016 Si | 6.7 | 6.7 | −1.2 | −5.5 | 0.1 | −230 |

*Average of duplicate L & T tests.
**Base chemistry is Ti—6.3 Al—4.2 V—.21 Fe—.15 $O_2$—.007 N—.024 C—.028 Si.

Although the strength levels for all of the alloys tested were reduced as a result of the anneal, nevertheless the alloy in accordance with the invention having carbon and silicon additions continued to demonstrate superior properties.

It may be noted from the data set forth above that the combined effect of carbon and silicon as addition agents is greater than the sum of the individual contributions.

What is claimed is:

1. An alpha-beta titanium-base alloy comprising in weight percent, 6 aluminum, 4 vanadium, 0.04 to 0.10 silicon and 0.03 to 0.08 carbon, said alloy having an increase in strength over that of the alloy absent said silicon and carbon additions.

2. The alloy of claim 1 wherein said alpha-beta titanium-base alloy additionally comprises, in weight percent, up to 0.3% iron and up to 0.25% oxygen.

* * * * *